US010280929B2

(12) United States Patent
Gahlot et al.

(10) Patent No.: US 10,280,929 B2
(45) Date of Patent: May 7, 2019

(54) MULTISTAGE CENTRIFUGAL PUMP WITH INTEGRAL ABRASION-RESISTANT AXIAL THRUST BEARINGS

(71) Applicant: GE Oil & Gas Esp, Inc., Oklahoma City, OK (US)

(72) Inventors: Vishal Gahlot, Moore, OK (US); Colby Lane Loveless, Oklahoma City, OK (US); Mark James, Oklahoma City, OK (US)

(73) Assignee: GE OIL & GAS ESP, INC., Oklahoma City, OK (US)

( * ) Notice: Subject to any disclaimer, the term of this patent is extended or adjusted under 35 U.S.C. 154(b) by 382 days.

(21) Appl. No.: 15/105,627

(22) PCT Filed: Dec. 18, 2013

(86) PCT No.: PCT/US2013/076261
§ 371 (c)(1),
(2) Date: Jun. 17, 2016

(87) PCT Pub. No.: WO2015/094249
PCT Pub. Date: Jun. 25, 2015

(65) Prior Publication Data

US 2017/0002823 A1 Jan. 5, 2017

(51) Int. Cl.
*F04D 29/041* (2006.01)
*F04D 29/06* (2006.01)
(Continued)

(52) U.S. Cl.
CPC ..... *F04D 29/041* (2013.01); *E21B 43/128* (2013.01); *F04B 47/06* (2013.01);
(Continued)

(58) Field of Classification Search
CPC ..... F04D 1/06; F04D 13/10; F04D 29/041; F04D 29/0413; F04D 29/0473;
(Continued)

(56) References Cited

U.S. PATENT DOCUMENTS 4,172,690 A * 10/1979 Kuntz ..... F04D 1/063 415/174.2
4,511,307 A * 4/1985 Drake ..... F04D 29/0413 415/170.1
(Continued)

FOREIGN PATENT DOCUMENTS

RU 2 322 616 C1 4/2008
RU 2 371 611 C1 10/2009
RU 2 371 613 C1 10/2009

OTHER PUBLICATIONS

Office Action and Search issued in connection with corresponding RU Application No. 2016124533 dated Oct. 19, 2017.
(Continued)

*Primary Examiner* — Igor Kershteyn
(74) *Attorney, Agent, or Firm* — GE Global Patent Operation

(57) ABSTRACT

A multistage centrifugal pump includes a housing, a rotatable shaft and first and second turbomachinery stages. The first turbomachinery stage includes a first diffuser connected to the housing, a first impeller connected to the rotatable shaft. The second turbomachinery stage includes a second diffuser connected to the housing and a second impeller connected to the rotatable shaft. The multistage centrifugal pump further includes an integral axial load and bearing system that includes at least one diffuser bushing and at least one impeller bearing. The integral axial load and bearing system permits the independent axial movement of the first and second impellers. The integral axial load and bearing system also provides an opposite force to up-thrust and down-thrust produced by the first and second turbomachinery stages.

14 Claims, 9 Drawing Sheets

(51) Int. Cl.

| | |
|---|---|
| ***F04D 1/06*** | (2006.01) |
| ***F04D 13/10*** | (2006.01) |
| ***F04D 29/047*** | (2006.01) |
| ***E21B 43/12*** | (2006.01) |
| ***F04B 47/06*** | (2006.01) |
| ***F04D 29/44*** | (2006.01) |

(52) U.S. Cl.
CPC ..... *F04D 1/06* (2013.01); *F04D 13/10* (2013.01); *F04D 29/0413* (2013.01); *F04D 29/0473* (2013.01); *F04D 29/061* (2013.01); *F04D 29/445* (2013.01)

(58) Field of Classification Search
CPC ..... F04D 29/061; F04D 29/445; F04B 47/06; E21B 42/128
See application file for complete search history.

(56) References Cited

U.S. PATENT DOCUMENTS 4,728,201 A * 3/1988 Abbe ..... F16C 17/045 384/100
5,033,937 A 7/1991 Wilson
5,160,240 A * 11/1992 Wilson ..... F04D 13/10 415/170.1
5,660,520 A * 8/1997 Scarsdale ..... E21B 43/128 415/104
5,722,812 A * 3/1998 Knox ..... F04D 1/06 415/199.1
5,765,950 A * 6/1998 Eno ..... F04D 29/0413 384/368
6,068,444 A 5/2000 Sheth
6,789,992 B2 * 9/2004 Horng ..... F16B 43/002 384/121
6,837,621 B1 * 1/2005 Sakamoto ..... E21B 4/003 384/97
7,575,413 B2 8/2009 Semple et al.
7,686,075 B2 * 3/2010 Stewart ..... E21B 43/128 166/105
7,708,466 B2 5/2010 Hsieh et al.
2008/0031731 A1 2/2008 Orban et al.
2010/0166344 A1 7/2010 Hori et al.

OTHER PUBLICATIONS

Decision to Grant issued in connection with corresponding RU Application No. 2016124533 dated Mar. 14, 2018.
PCT Search Report and Written Opinion issued in connection with corresponding PCT Application No. PCT/US2013/076261 dated Sep. 29, 2014.

* cited by examiner

MULTISTAGE CENTRIFUGAL PUMP WITH INTEGRAL ABRASION-RESISTANT AXIAL THRUST BEARINGS

BACKGROUND

Embodiments of the multistage centrifugal pump with integral abrasion-resistant axial thrust bearings relates generally to the field of downhole turbomachines, and more particularly to multistage centrifugal pump that includes integral axial thrust bearings.

Submersible pumping systems are often deployed into wells to recover petroleum fluids from subterranean reservoirs. Typically, a submersible pumping system includes a number of components, including an electric motor coupled to one or more high performance pump assemblies. Production tubing is connected to the pump assemblies to deliver the petroleum fluids from the subterranean reservoir to a storage facility on the surface. The pump assemblies often employ axially and centrifugally oriented multi-stage turbomachines.

Most downhole turbomachines include one or more impeller and diffuser combinations, commonly referred to as "stages." The impellers rotate within adjacent stationary diffusers. A shaft keyed only to the impellers transfers mechanical energy from the motor. During use, the rotating impeller imparts kinetic energy to the fluid. A portion of the kinetic energy is converted to pressure as the fluid passes through the downstream diffuser.

During operation, each impeller generates thrust in an upward or downward direction. "Up-thrust" occurs as fluid moving through the impeller pushes the impeller upward. "Down-thrust" occurs when the force imparted by the impeller to the fluid creates a reactive downward force. All multistage centrifugal pumps have a single flow rate equilibrium point where the up-thrust and down-thrust generated by the impellers are balanced. Operating the pump at flow rate outside the equilibrium point causes the up-thrust and down-thrust forces to become unbalanced. Lower flow rates cause excess down-thrust, while higher flow rates may cause excess up-thrust. To avoid these out-of-balance forces, the pump is provided with a narrow operating range.

In the past, large thrust-bearings have been used to control the aggregated thrust load from the entire impeller stack. Large thrust bearings are complicated to manufacture and wear over time. To be effective, the large thrust bearings and turbomachinery stages must be accurately shimmed and balanced to properly place the thrust loads at the thrust bearing.

SUMMARY

In an embodiment, the present invention includes a multistage centrifugal pump. The multistage centrifugal pump includes a housing, a rotatable shaft and first and second turbomachinery stages. The first turbomachinery stage includes a first diffuser connected to the housing, a first impeller connected to the rotatable shaft. The second turbomachinery stage includes a second diffuser connected to the housing and a second impeller connected to the rotatable shaft. The multistage centrifugal pump further includes an integral axial load and bearing system that includes at least one diffuser bushing and at least one impeller bearing. The integral axial load and bearing system permits the independent axial movement of the impellers in each module and the rotatable shaft. The integral axial load and bearing system also provides an opposite force to up-thrust and down-thrust produced by one or more turbomachinery stages in each module.

In another aspect, the embodiments include a multistage centrifugal pump that has a rotatable shaft, an upstream impeller connected to the rotatable shaft, a stationary diffuser and a downstream impeller connected to the rotatable shaft. The multistage centrifugal pump further includes an integral axial load and bearing system that includes a diffuser bushing contained within the stationary diffuser, an upstream impeller bearing connected to the rotatable shaft, and a downstream impeller bearing connected to the rotatable shaft.

In yet another embodiment, a pumping system includes a motor and a multistage centrifugal pump driven by the motor. The multistage centrifugal pump includes a rotatable shaft, an upstream stage and a downstream stage. The upstream stage includes an upstream diffuser and an upstream impeller. The downstream stage includes a downstream diffuser and a downstream impeller. The multistage centrifugal pump further includes a first integral axial load and bearing system within the upstream stage. The first integral axial load and bearing system includes a diffuser bushing contained within the stationary diffuser, an upstream impeller bearing connected to the rotatable shaft, and a downstream impeller bearing connected to the rotatable shaft.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
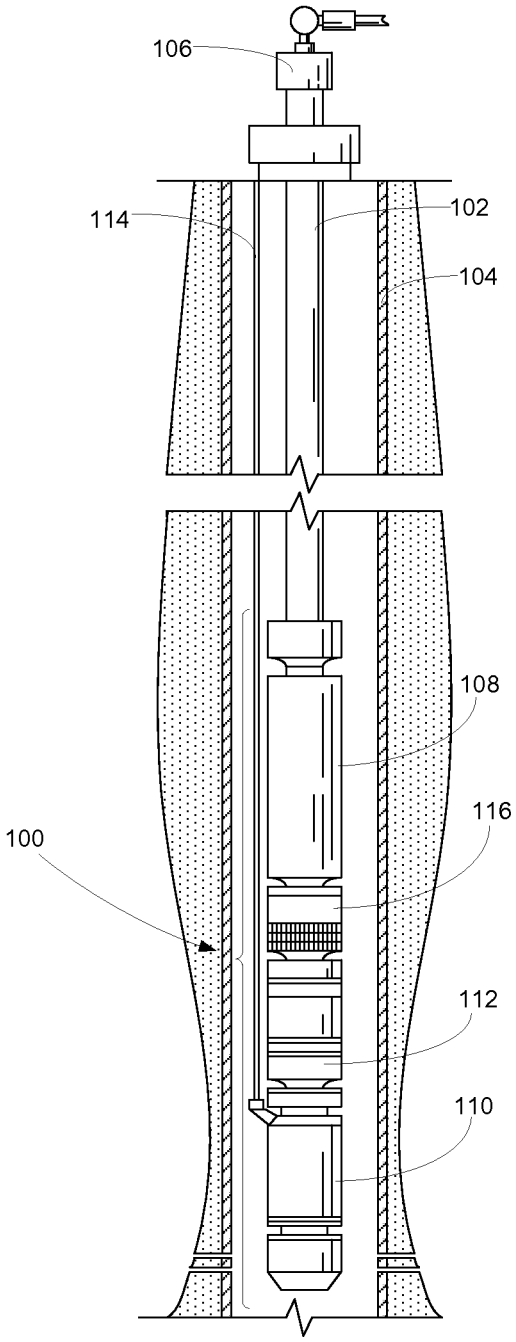
FIG. 1 is an elevational depiction of a submersible pumping system constructed in accordance with a embodiment.

Due to the deficiencies described above, there is therefore a continued need for an improved pump assembly that more effectively and reliably manages axial thrust. It is to these and other deficiencies in the prior art that the present application is directed. In accordance with embodiments discussed herein, FIG. 1 shows an elevational view of a pumping system 100 attached to production tubing 102. The pumping system 100 and production tubing are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that embodiments can also be used to move other fluids.

The pumping system 100 includes some combination of a pump 108, a motor 110 and a seal section 112. The seal section 112 shields the motor 110 from wellbore fluids and accommodates the thermal expansion of lubricants within the motor 110. The motor 110 is provided with power from the surface by a power cable 114. Although only one pump 108 and one motor 110 are shown, it will be understood that more can be connected when appropriate. The pump 108 is fitted with an intake section 116 to allow well fluids from the wellbore 104 to enter the pump 108, where the well fluid is forced to the surface through the production tubing 102. It will also be appreciated that the pumping system 100 may be deployed in surface-mounted applications, which may include, for example, the transfer of fluids between storage facilities, the removal of liquid on surface drainage jobs, the withdrawal of liquids from subterranean formations and the injection of fluids into subterranean wells.

Although the pumping system 100 is depicted in a conventional "vertical" orientation, it will be appreciated that embodiments of the pumping system 100 can also be installed in horizontal, deviated, or other non-vertical installations. As used in this disclosure, the use of the terms "upper" and "lower" should not be construed as limiting the embodiments to a vertical orientation of the pumping system 100. Instead, as used in this disclosure, the terms "upper" and "lower" are analogous to "downstream" and "upstream," respectively. The terms "downstream" and "upstream" are relative positional references that are based on the movement of fluid through the pump 108.

Figure 2:
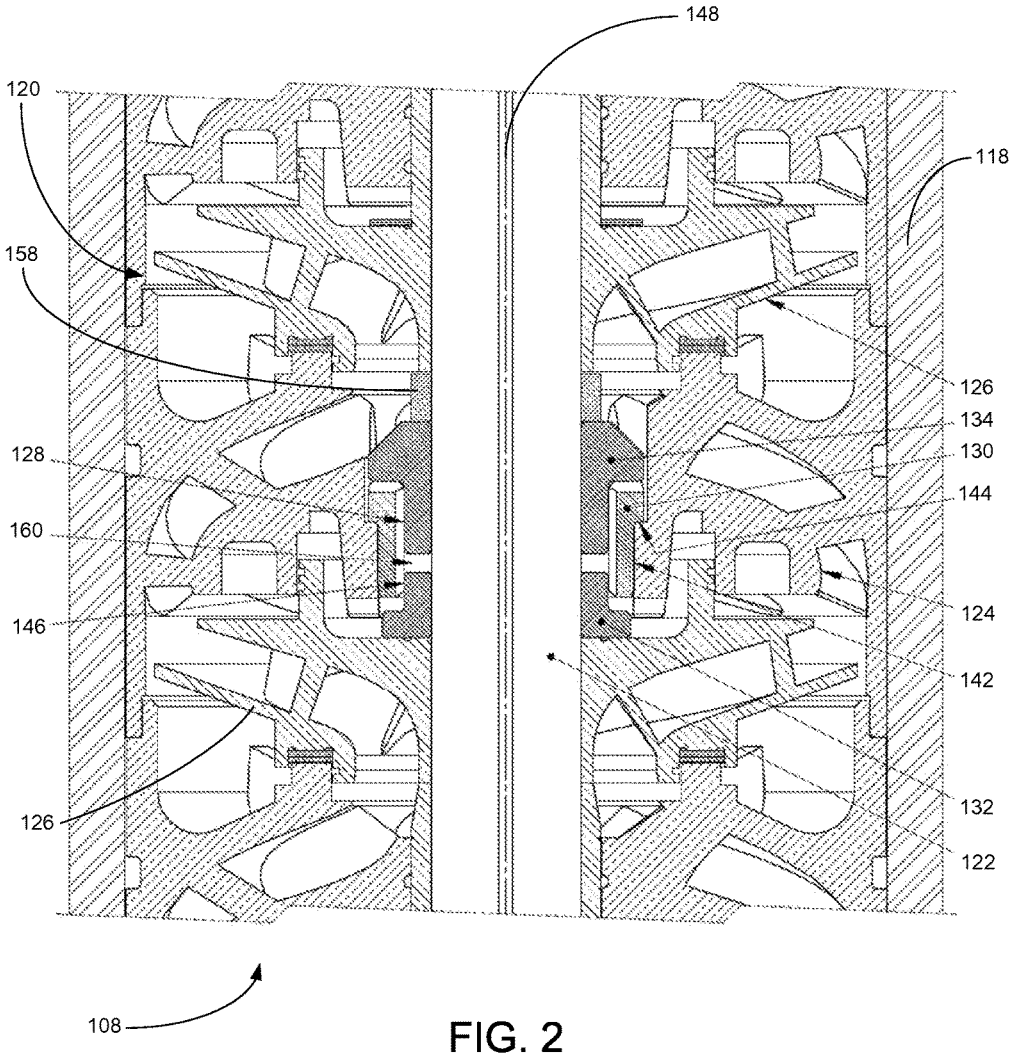
FIG. 2 is a cross-sectional view of a portion of the pump assembly of FIG. 1 constructed in accordance with a first embodiment.

Turning to FIG. 2, shown therein is a cross-sectional view of a portion of the pump 108 constructed in accordance with a first embodiment. The pump 108 includes an optional pump housing 118, one or more turbomachinery stages 120 and a shaft 122. Each of stages 120 includes a diffuser 124 and an impeller 126. Each impeller 126 is connected to the shaft 122 through a keyed connection such that the impellers 126 rotate with the shaft 122. The keyed connection permits a limited amount of axial movement between the impellers 126 and the shaft 122. Each of the diffusers 124 is held in a stationary position within the pump housing 118 by a compressive load or bolted connection. In this way, the shaft 122 and impellers 126 rotate within the stationary diffusers 124. Multiple stages 120 may be grouped together in "modules" for functional and control purposes. A single pump 108 may include a plurality of modules of impellers 126 and diffusers 124.

The pump 108 further includes one or more integral axial load and bearing system 128. Generally, the integral axial load and bearing system 128 provides radial support to the rotating components and offsets axial thrust loads imparted in upstream and downstream directions through the pump 108. In presently embodiments, the pump 108 includes a separate integral axial load and bearing system 128 between each module of impellers 126. It will be appreciated, however, that the integral axial load and bearing system 128 may be implemented within each stage 120 of the pump 108. Each of the components of the integral axial load and bearing system 128 is manufactured from hardened, wear-resistant metal. The use of wear-resistant metal for the components of the integral axial load and bearing system 128 represents an advancement over the use of prior art hardened, polymer and plastic bearings. The use of the integral axial load and bearing system 128 obviates or reduces the need for separate, dedicated thrust bearings in the seal section 112.

Figure 3:
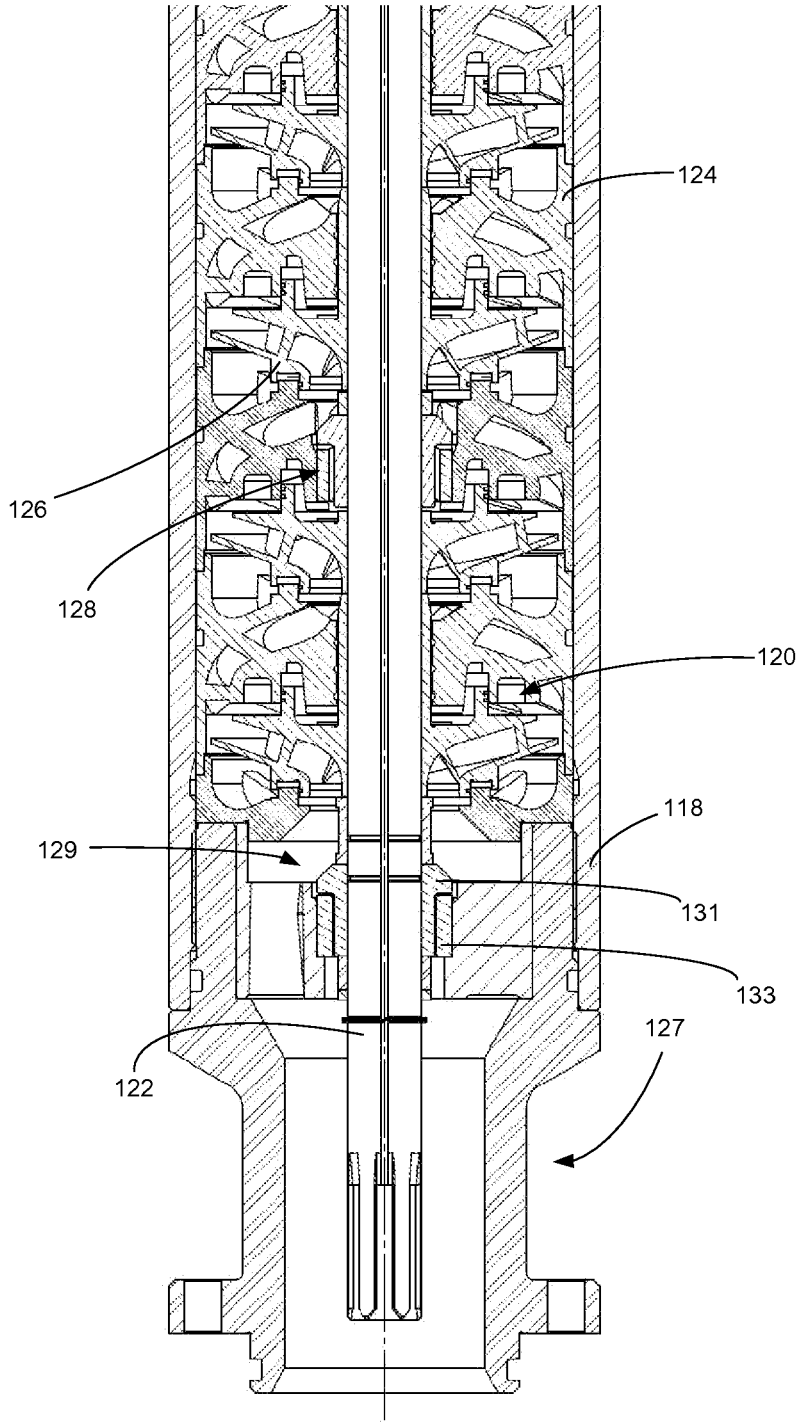
FIG. 3 is a cross-sectional view of the base of the pump assembly of FIG. 1 constructed in accordance with a first embodiment.

Turning to FIG. 3, shown therein is a cross-sectional view of a base 127 of the pump 108. In a particularly embodiment, the pump 108 includes a primary thrust bearing 129 upstream of the first stage 120. The primary thrust bearing 129 includes a thrust runner 131 secured to the shaft 122 and a stationary member 133 secured within the base 127. The primary thrust bearing 129 provides radial and longitudinal support to the shaft 122. The primary thrust bearing 129 and downstream integral axial load systems 128 are configured such that the downthrust load from the first upstream stages 120 is principally offset and limited by the primary thrust bearing 129. The use of an independent primary thrust bearing 129 reduces the wear on downstream integral axial load and bearing systems 128.

Figure 4:
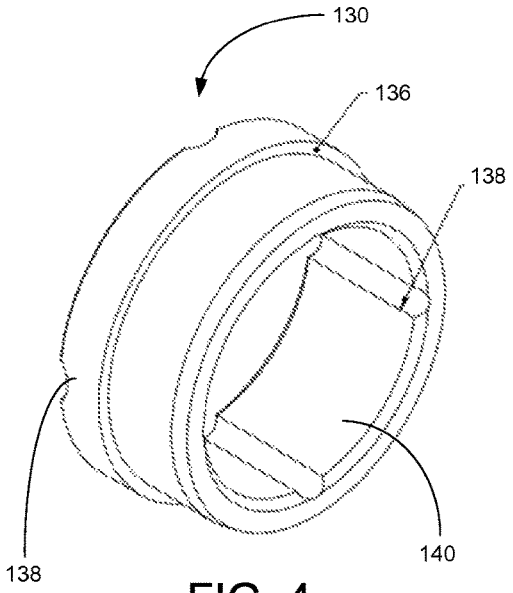
FIG. 4 is a perspective view of a diffuser bushing from the first embodiment depicted in FIG. 2.
Figure 5:
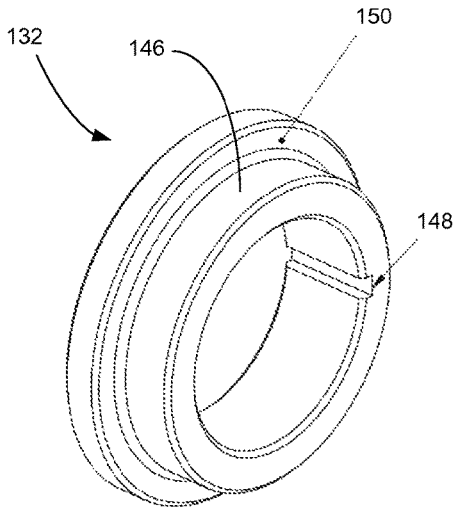
FIG. 5 is a perspective view of an upper impeller bearing from the first embodiment depicted in FIG. 2.
Figure 6:
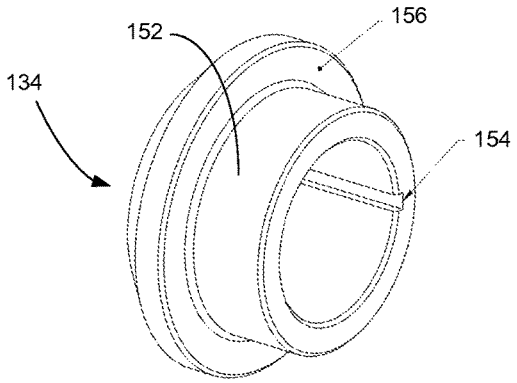
FIG. 6 is a perspective view of a lower impeller bearing from the first embodiment depicted in FIG. 2.

In the first embodiment depicted in FIG. 2, the integral axial load and bearing system 128 includes a diffuser bushing 130, an upstream impeller bearing 132 and a downstream impeller bearing 134. Turning to FIGS. 4-6, shown therein are perspective views of the diffuser bushing 130, upstream impeller bearing 132 and downstream impeller bearing 134, respectively. The diffuser bushing 130 includes a flanged end 136, one or more lubricant channels 138 and a central interior passage 140. The central interior passage 140 extends along the longitudinal axis of the diffuser bushing 130. The lubricant channels 138 extend along the central interior passage 140 and extend radially outward through the flanged end 136. The diffuser bushing 130 is held by an interference fit within a diffuser bushing counter bore 142 within the diffuser 124. The counter bore 142 includes a shoulder 144 that holds the flanged end 136 of the diffuser bushing 130.

The upstream impeller bearing 132 includes a central cylinder 146, a keyway 148 and a collar 150. The upstream impeller bearing 132 is keyed to the shaft 122 with keyway 148. Similarly, the downstream impeller bearing 134 includes a central cylinder 152, a keyway 154 and a collar 156. The downstream impeller bearing 134 is connected to the shaft 122 with the keyway 154. The upstream and downstream impeller bearings 132, 134 provide axial and radial support to the shaft 122 and impellers 126.

As illustrated in FIG. 2, the collar 156 of the upstream impeller bearing 132 resides on the downstream, discharge end of the impeller 126. The central cylinder 146 of the upstream impeller bearing 132 fits inside the upstream portion of the central interior passage 140 of the diffuser bushing 130. The central cylinder 152 of the downstream impeller bearing 134 fits within the downstream portion of the central interior passage 140 of the diffuser bushing 130. In this way, the downstream impeller bearing 134 supports the adjacent downstream impeller 126. One or more impeller shims 158 may be positioned between the downstream impeller bearing 134 and the downstream impeller 126.

In a particularly embodiment, the integral axial load and bearing system 128 is configured such that there is a gap 160 between the central cylinder 152 of the downstream impeller bearing 134 and the central cylinder 146 of the upstream impeller bearing 132. The gap 160 allows each of the adjacent impeller 126 to axially displace within a permitted tolerance. In this way, each of the stages 120 is permitted to find its own equilibrium point and the thrust forces generated by each impeller 126 are absorbed by the adjacent diffusers 124.

Notably, the integral axial load and bearing system 128 allows each module of pump impellers 126 to independently move in an axial direction from the impellers in other modules. The independent axial displacement of the individual impellers 126 can be accomplished by allowing the impellers 126 to move along the shaft 122, by providing for the axial displacement of the shaft 122 with the impellers 126 within a particular module fixed in position along the shaft 122, or by a combination of impellers 126 and shafts 122 configured for axial movement.

Figure 7:
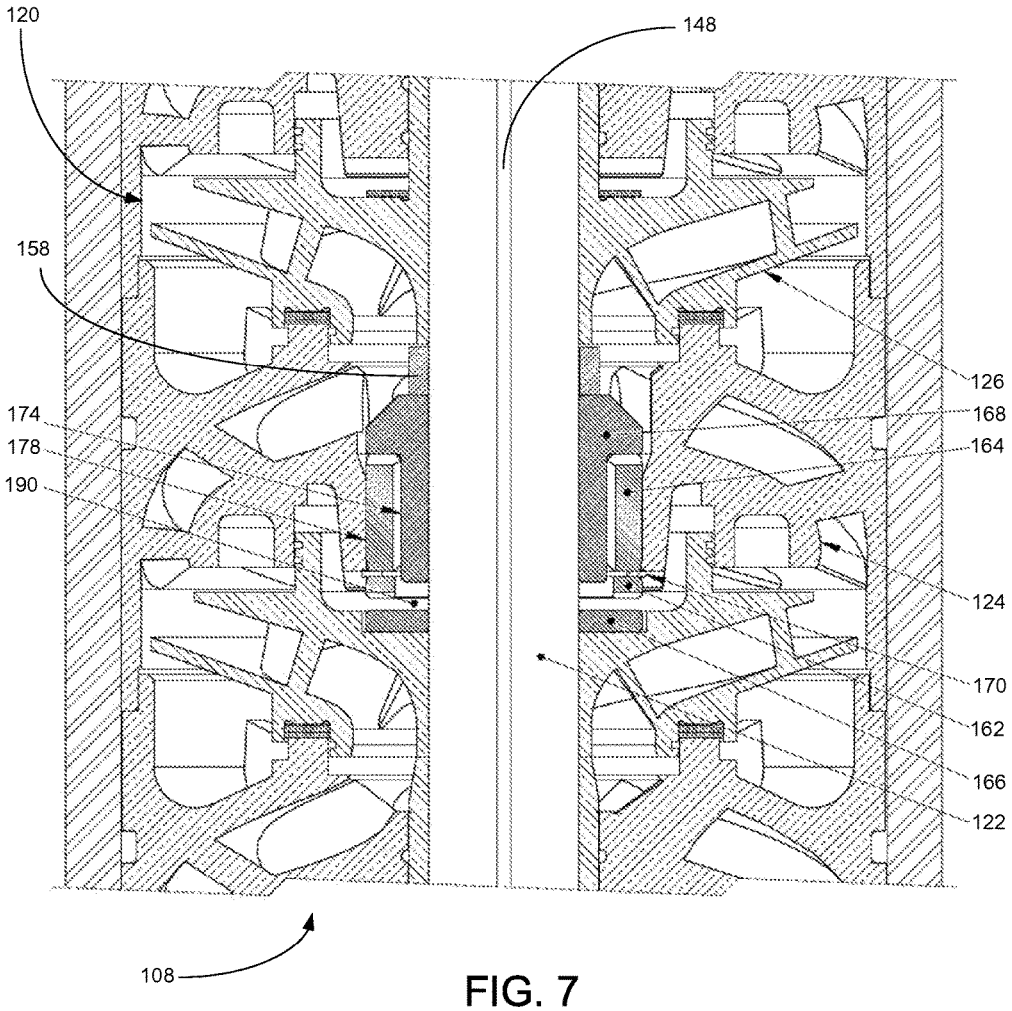
FIG. 7 is a cross-sectional view of a portion of the pump assembly of FIG. 1 constructed in accordance with a second embodiment.

Turning to FIG. 7, shown therein is a cross-sectional view of a portion of the pump 108 constructed in accordance with a second embodiment. In the second embodiment, the integral axial load and bearing system 128 includes an upstream diffuser bushing 162, a downstream diffuser bushing 164, an upstream impeller bearing 166, a downstream impeller bearing 168 and a lock ring 170. The integral axial load system 128 depicted in FIG. 7 is also included in the illustration of the pump 108 in FIG. 3.

Figure 8:
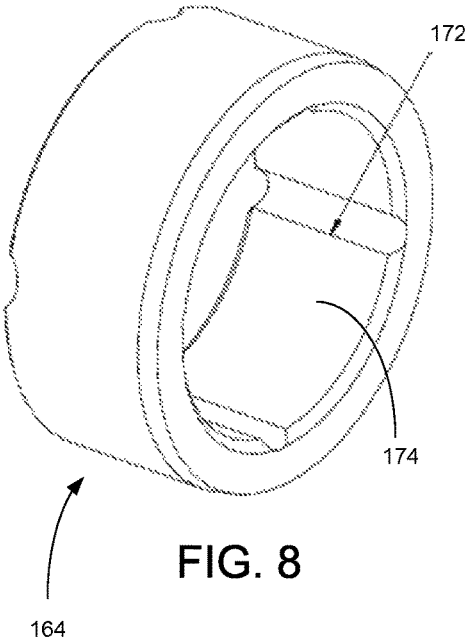
FIG. 8 is a perspective view of an upper diffuser bushing from the second embodiment depicted in FIG. 7.
Figure 9:
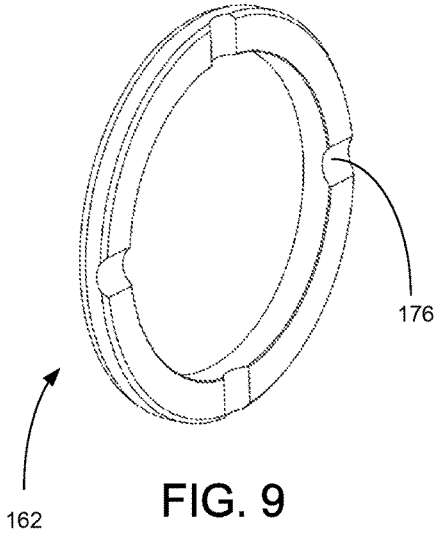
FIG. 9 is a perspective view of a lower diffuser bushing from the second embodiment depicted in FIG. 7.
Figure 10:
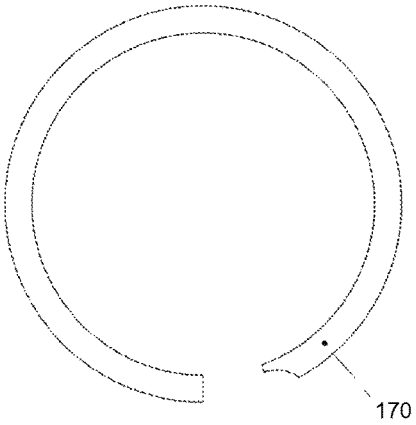
FIG. 10 is a perspective view of a diffuser bushing retainer ring from the second embodiment depicted in FIG. 7.

As depicted in FIGS. 8-10, the downstream diffuser bushing 164 includes a series of axial lubricant channels 172 and a central interior passage 174. The upstream diffuser bushing 162 includes a series of radial lubricant channels 176. The downstream diffuser bushing 164 and upstream diffuser bushing 162 each reside within a through-bore 178 extending axially through the center of the diffuser 124. The lock ring 170 places the upstream and downstream diffuser bushings 164, 162 within the through-bore 178.

Figure 11:
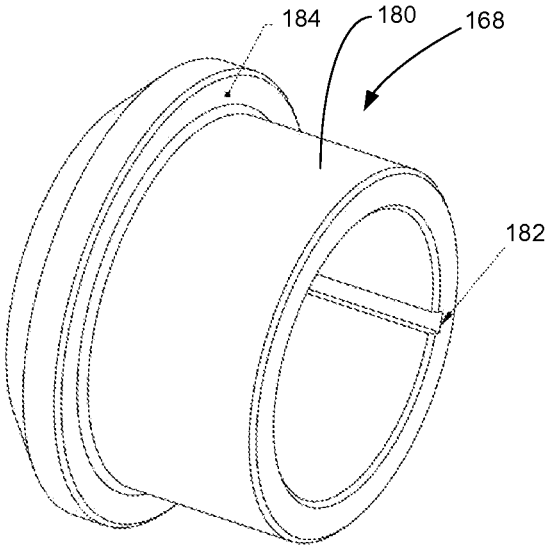
FIG. 11 is a perspective view of an upper impeller bearing from the second embodiment depicted in FIG. 7.
Figure 12:
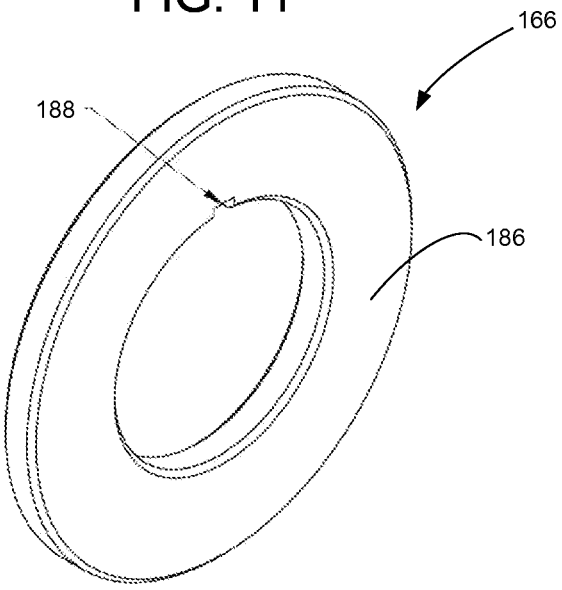
FIG. 12 is a perspective view of a lower impeller bearing from the second embodiment depicted in FIG. 7.

Turning to FIGS. 11-12, the downstream impeller bearing 168 includes a central cylinder 180, a keyway 182 and a collar 184. The downstream impeller bearing 168 is keyed to the shaft 122 with keyway 182. The upstream impeller bearing 166 includes a cylindrical body 186 and a key slot 188. The upstream impeller bearing 166 is keyed to the shaft 122 with the key slot 188. The upstream and downstream impeller bearings 166, 168 provide axial and radial support to the shaft 122 and impellers 126.

As illustrated in FIG. 7, the upstream impeller bearing 166 resides on the downstream, discharge end of the impeller 126. The central cylinder 180 of the downstream impeller bearing 168 fits inside the upstream portion of the central interior passage 174 of the downstream diffuser bushing 164. In this way, the downstream impeller bearing 168 supports the adjacent downstream impeller 126. One or more impeller shims 158 may be positioned between the downstream impeller bearing 168 and the downstream impeller 126.

The upstream impeller bearing 166 is adjacent to, and spaced apart from, the upstream diffuser bushing 162. The embodiment, the upstream impeller bearing 166 and upstream diffuser bushing 162 are spaced apart by a gap 190. The gap 190 allows each of the upstream impeller 126 to axially displace within a permitted tolerance. The adjacent downstream impeller 126 is similarly allowed to axially displace as the downstream impeller bearing 168 moves within the central interior passage 174 of the downstream diffuser bushing 168. In this way, each of the stages 120 is permitted to find its own equilibrium point and the thrust forces generated by each impeller 126 are absorbed by the integral axial load and bearing system 128 within the adjacent diffusers 124.

Figure 13:
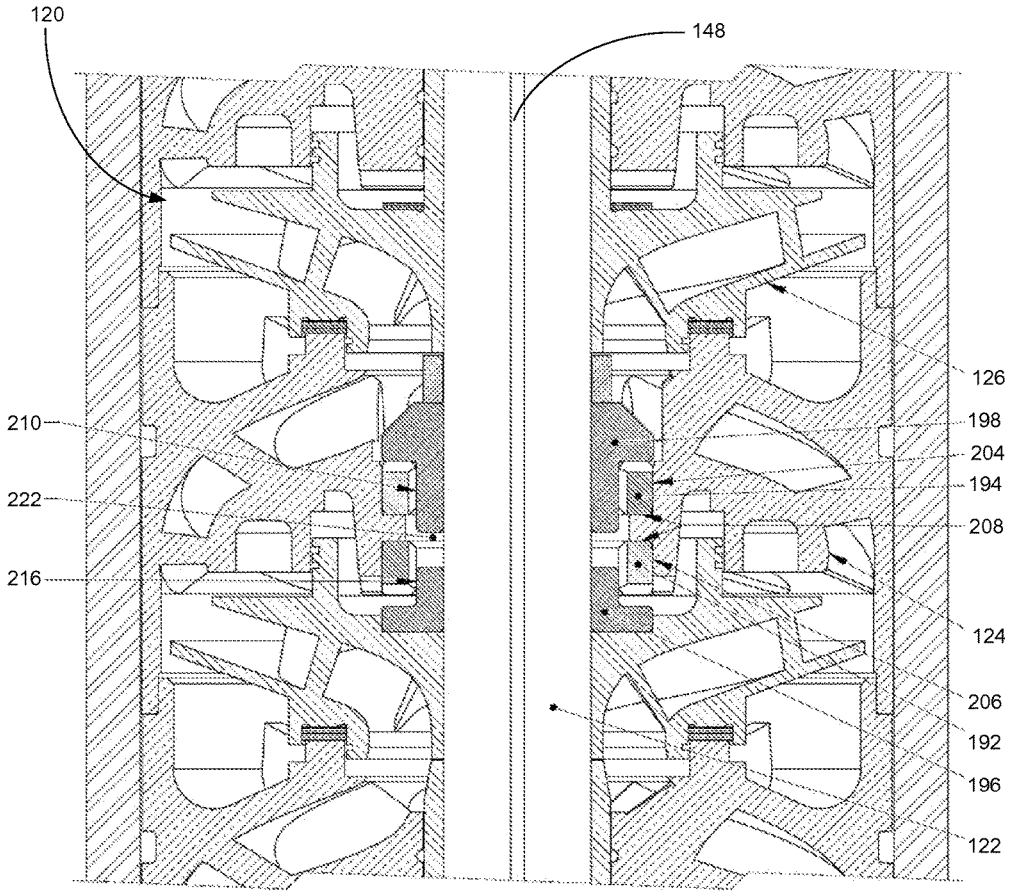
FIG. 13 is a cross-sectional view of a portion of the pump assembly of FIG. 1 constructed in accordance with a third embodiment.

Turning to FIG. 13, shown therein is a cross-sectional view of a portion of the pump 108 constructed in accordance with a third embodiment. In the embodiment, the integral axial load and bearing system 128 includes an upstream diffuser bushing 192, a downstream diffuser bushing 194, an upstream impeller bearing 196 and a downstream impeller bearing 198.

Figure 14:
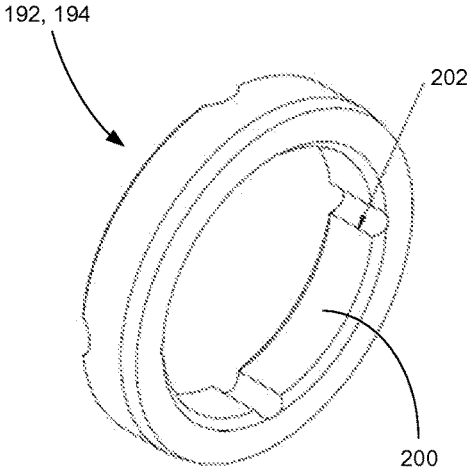
FIG. 14 is a perspective view of the diffuser bushing from the third embodiment depicted in FIG. 13.

As noted in FIG. 14, the upstream and downstream diffuser bushings 192, 194 have substantially similar constructions. Each of the upstream and downstream diffuser bushings 192, 194 includes a central interior passage 200 and a plurality of axial lubricant channels 202. The upstream and downstream diffuser bushings 192, 194 are secured by an interference fit within upstream and downstream counter bores 204, 206, respectively. The counter bores 204, 206 are separated by a lip 208. During manufacture, the upstream and downstream diffuser bushings 192, 194 are pressed into a respective counter bore 204, 206 until the diffuser bushings 192, 194 abut the lip 208.

Figure 15:
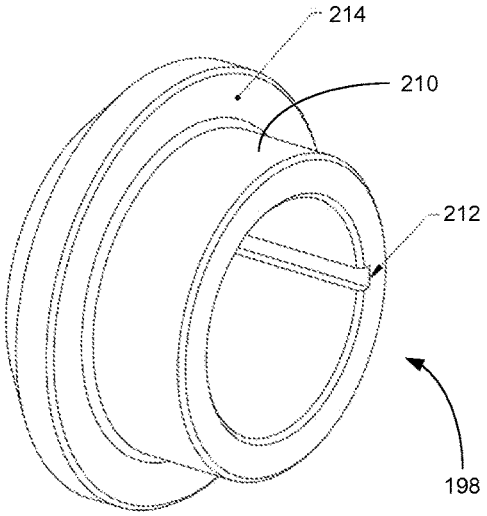
FIG. 15 is a perspective view of the upper impeller bearing from the third embodiment depicted in FIG. 13.
Figure 16:
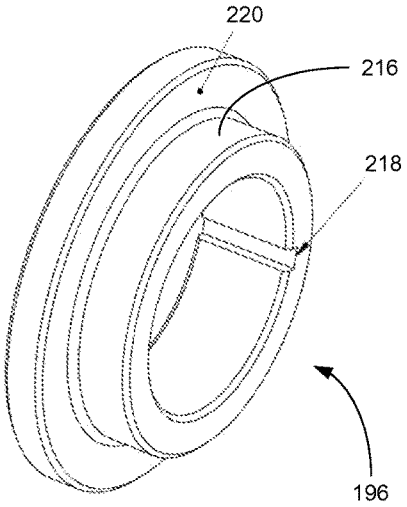
FIG. 16 is a perspective view of the lower impeller bearing from the third embodiment depicted in FIG. 13.

Turning to FIGS. 15 and 16, shown therein are perspective views of the upstream impeller bearing 196 and downstream impeller bearing 198. The downstream impeller bearing 198 includes a central cylinder 210, a keyway 212 and a collar 214. The upstream impeller bearing 196 is keyed to the shaft 122 with keyway 218. The upstream impeller bearing 196 includes a central cylinder 216, a keyway 218 and a collar 220. The upstream impeller bearing 196 is keyed to the shaft 122 with keyway 218. The upstream and downstream impeller bearings 196, 198 provide axial and radial support to the shaft 122 and impellers 126.

As illustrated in FIG. 13, the upstream impeller bearing 196 resides on the downstream, discharge end of the impeller 126. The upstream impeller bearing 196 is adjacent to, and spaced apart from, the upstream diffuser bushing 192. The central cylinder 216 of the upstream impeller bearing 196 fits inside the central interior passage 200 of the upstream diffuser bushing 192.

The downstream impeller bearing 198 is supported by the downstream diffuser bushing 194. The central cylinder 210 of the downstream impeller bearing 198 fits inside the central interior passage 200 of the downstream diffuser bushing 194. The length of the central cylinder 216 of the upstream impeller bearing 196 and the configuration of the upstream diffuser bushing 192, the downstream diffuser bushing 194 and the downstream impeller bearing 198 creates a gap 222 between the adjacent upstream and downstream impeller bearings 196, 198. The gap 222 permits modules of impellers 126 to move together within the pump 108.

Thus in each of the embodiments, the integral axial load and bearing system 128 provides an abrasive-resistant thrust-management system that is internal to the pump 108. Unlike prior art designs in which the aggregated thrust load is conveyed by the shaft 122 and managed by large complicated thrust bearings, the integral axial load and bearing system 128 controls thrust produced by individual stages 120 or modules of stages 120 within the pump 108. Because the integral axial load and bearing system 128 controls up-thrust and down-thrust produced by individual stages 120 or modules of stages 120, the pump 108 can be operated over a wide range of flow rates. The ability to operate the pump 108 over a wide range of flow rates presents a significant advancement over the prior art.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles to the full extent indicated by the broad general meaning of the terms in which the appended claims are expressed. It will be appreciated by those skilled in the art that the teachings discussed herein can be applied to other systems without departing from the scope and spirit of the embodiments within the application.

What is claimed is:

1. A multistage centrifugal pump comprising:
a rotatable shaft;
an upstream impeller connected to the rotatable shaft;
a stationary diffuser;
a downstream impeller connected to the rotatable shaft; and
an integral axial load and bearing system, wherein the integral axial load and bearing system comprises:
a diffuser bushing contained within the stationary diffuser;
an upstream impeller bearing connected to the rotatable shaft; and
a downstream impeller bearing connected to the rotatable shaft,
wherein the diffuser bushing comprises a central interior passage and the upstream impeller bearing—comprises a central cylinder that extends inside the central interior passage of the diffuser bushing,
wherein the downstream impeller bearing comprises a central cylinder that extends inside the central interior passage of the diffuser bushing, and
wherein the integral axial load and bearing system further comprises a gap within the interior of the diffuser bushing between the central cylinder of the upstream impeller bearing and the central cylinder of the downstream impeller bearing, wherein the gap permits the axial displacement of the upstream impeller and downstream impeller with respect to the diffuser.

2. The multistage centrifugal pump of claim 1, wherein the diffuser bushing comprises a flanged end and at least one lubricant channel.

3. The multistage centrifugal pump of claim 1, wherein the diffuser bushing is a downstream diffuser bushing and wherein the integral axial load and bearing system further comprises an upstream diffuser bushing.

4. The multistage centrifugal pump of claim 3, wherein the downstream diffuser bushing comprises a central interior passage and the downstream impeller bearing comprises a central cylinder that extends inside the central interior passage of the downstream diffuser bushing.

5. The centrifugal pump of claim 4, wherein upstream impeller bearing comprises a cylindrical body that is connected to the shaft and spaced apart from the upstream diffuser bushing to create a gap that permits the axial displacement of the upstream diffuser with respect to the diffuser.

6. The multistage centrifugal pump of claim 3, wherein the upstream diffuser bushing and the downstream diffuser bushing are each retained within separate counter bores within the diffuser.

7. A pumping system comprising:
a motor; and
a multistage centrifugal pump driven by the motor, the multistage centrifugal pump comprising:
a rotatable shaft;
an upstream stage, wherein the upstream stage—comprises an upstream diffuser and an upstream impeller;
a downstream stage, wherein the downstream stage—comprises a downstream diffuser and a downstream impeller; and
a first integral axial load and bearing system within the upstream stage, wherein the first integral axial load and bearing system comprises:
a first diffuser bushing contained within the upstream diffuser;
a first upstream impeller bearing connected to the rotatable shaft; and
a first downstream impeller bearing connected to the rotatable shaft,
wherein the pump comprises a second integral axial load and bearing system within the downstream stage, and
wherein the upstream stage is not adjacent to the downstream stage.

8. The pumping system of claim 7, wherein the upstream stage is adjacent to the downstream stage.

9. The pumping system of claim 7, wherein the second integral axial load and bearing system comprises:
a second diffuser bushing contained within the downstream diffuser;
a second upstream impeller bearing connected to the rotatable shaft; and
a second downstream impeller bearing connected to the rotatable shaft.

10. The pumping system of claim 9, wherein within the first integral axial load and bearing system, the diffuser bushing—comprises a central interior passage and the upstream impeller bearing—comprises a central cylinder that extends inside the central interior passage of the diffuser bushing.

11. The pumping system of claim 10, wherein within the first integral axial load and bearing system, the downstream impeller bearing—comprises a central cylinder that extends inside the central interior passage of the diffuser bushing.

12. The pumping system of claim 11, wherein the first and second integral axial load and bearing systems each further comprise a gap within the interior of the diffuser bushing between the central cylinder of the upstream impeller bearing and the central cylinder of the downstream impeller bearing, wherein the gap permits the axial displacement of the upstream impeller and downstream impeller.

13. A multistage centrifugal pump comprising:
a housing;
a rotatable shaft;
a first turbomachinery stage, wherein the first turbomachinery stage comprises:
a first diffuser connected to the housing; and
a first impeller connected to the rotatable shaft;
a second turbomachinery stage, wherein the second turbomachinery stage comprises:
a second diffuser connected to the housing; and
a second impeller connected to the rotatable shaft; and an integral axial load and bearing system, wherein the integral axial load and bearing system—comprises at least one diffuser bushing and at least one impeller bearing that together permit the independent axial movement of the first and second impellers, wherein the integral axial load and bearing system further comprises:

a first diffuser bushing contained within the first diffuser;

an upstream impeller bearing connected to the rotatable shaft; and a downstream impeller bearing connected to the rotatable shaft, and wherein the integral axial load and bearing system further comprises a second diffuser bushing contained within the first diffuser.

14. The multistage centrifugal pump of claim 13, further comprising:

a pump base; and a primary thrust bearing positioned inside the pump base.

* * * * *